US005094470A

United States Patent [19]

Riedel

[11] Patent Number: 5,094,470

[45] Date of Patent: Mar. 10, 1992

[54] BINDING APPARATUS HAVING LINKED BINDING ASSEMBLIES

[75] Inventor: Tilo Riedel, Piding, Fed. Rep. of Germany

[73] Assignee: Salomon S.A., Annecy Cedex, France

[21] Appl. No.: 513,675

[22] Filed: Apr. 24, 1990

[30] Foreign Application Priority Data

Apr. 25, 1989 [FR] France ..... 89 05476

[51] Int. Cl.[5] ..... A63C 5/00; A63C 9/00

[52] U.S. Cl. ..... 280/607; 280/618; 280/634; 280/14.2

[58] Field of Search ..... 280/14.2, 14.3, 11.31, 280/607, 616, 618, 620, 621, 623, 625, 627, 633, 634, 636; 441/61, 62, 63, 70, 74

[56] References Cited

U.S. PATENT DOCUMENTS

| | | | |
|---|---|---|---|
| 3,197,222 | 7/1965 | Marcus | 280/622 |
| 4,403,785 | 9/1983 | Hottel | 280/14.2 |
| 4,652,007 | 3/1987 | Dennis | 280/618 |
| 4,741,550 | 5/1988 | Dennis | 280/618 |
| 4,792,155 | 12/1988 | Besnier | 280/607 |
| 4,844,502 | 7/1989 | Besnier | 280/607 |
| 4,869,522 | 9/1989 | Besnier et al. | 280/607 |
| 4,869,524 | 9/1989 | Bouque | 280/617 |
| 4,955,632 | 9/1990 | Giarritta et al. | 280/14.2 |

FOREIGN PATENT DOCUMENTS

| | | | |
|---|---|---|---|
| 0350411 | 1/1990 | European Pat. Off. | 280/14.2 |
| 88019721 | 5/1988 | Fed. Rep. of Germany . | |
| 2615115 | 11/1988 | France | 280/607 |
| 2628000 | 9/1989 | France | 280/618 |
| 2630922 | 11/1989 | France | 280/14.2 |
| 2631841 | 12/1989 | France | 280/14.2 |

*Primary Examiner*—Andres Kashnikow
*Assistant Examiner*—Brian L. Johnson
*Attorney, Agent, or Firm*—Sandler, Greenblum, & Bernstein

[57] ABSTRACT

A binding apparatus for a pair of boots of a skier on a snow-sliding board, such as a surf board or a monoski. The apparatus includes a front and rear passive type of binding assemblies, not including individual elastic biasing mechanisms. The binding assemblies are linked to one another via a common energizing mechanism placed between the two assemblies and include, in a central part of the mechanism, an energizing mechanism which is connected, via flexible linking devices, to movable parts of the individual binding assemblies, which include the retention jaws for the skier's boots.

41 Claims, 3 Drawing Sheets

BINDING APPARATUS HAVING LINKED BINDING ASSEMBLIES

BACKGROUND OF THE INVENTION

1. Field of the Invention

The present invention relates to a binding apparatus for releasably securing a pair of boots for a skier on a snow sliding board, such as a snowboard or a monoski.

2. Description of Background and Other Information

The practice of snow surfing, or snowboarding, in which the skier uses a single board having an upwardly curved front end, has developed rapidly in recent few years. In practicing this sport, the skier positions himself or herself transversely with respect to the longitudinal axis of the board. It is known to furnish the board with a binding apparatus for the skier's two boots, in order to maintain the rear foot (right or left according to the stance of the skier) and the front foot (left or right) at inclined positions in relation to the longitudinal axis of the board, in a manner that the two feet of the skier are either parallel or divergent in relation to each other.

Such a binding apparatus is described, for example, in U.S. Pat. No. 4,652,007. This binding apparatus includes means for permitting a triggered release in case of a fall, which results in a biasing of the legs of the skier which is susceptible of provoking an accident. The apparatus described in the above-cited patent includes two binding assemblies, associated respectively with the front and rear boots, and in which the two binding assemblies are linked by an intermediate element in such a way that the release of one of the binding assemblies, which otherwise ensures the retention of a boot, facilitates the release of the other boot.

In such an apparatus, each binding assembly comprises two releasable bindings which are presently known and used for the practice of alpine skiing. Further, each of the binding assemblies are aligned along the longitudinal axis of the snowboard and cooperate with two opposite parts, which are aligned in the longitudinal direction of the board, and which are part of a plate supporting a ski boot. One of the binding assemblies, located on one side of the boot-supporting plate, is a front abutment with a jaw maintaining the front end of an alpine ski boot, while the other binding assembly, which is located on the other side of the boot-supporting plate, is a heel abutment, normally maintaining the heel of a boot on an alpine ski.

However, the alpine ski bindings used in this known apparatus are not, in fact, adapted to the practice of snowboarding, during which the biases exerted by the boots on the bindings are different from those exerted during the practice of alpine skiing.

Further, in the binding apparatus according to U.S. Pat. No. 4,652,007, the front and rear boot-supporting plates are constructed differently. In fact, the support area for the rear boot on the rear support plate extends perpendicularly to the axis of the two lateral parts of the plate maintained by the two release bindings placed on both sides of the boot-supporting plate, while the support area of the front boot on the front support plate is inclined towards the front in relation to the two lateral parts, ensuring the linkage with the two opposite release bindings. In other words, the rear boot-supporting plate has approximately a cross shape (+), while the front boot-supporting plate has the shape of an X. Because of this, the positions of the boots and, particularly, that of the front boot, are predetermined on the ski. However, this constitutes an inconvenience to the extent that each skier can prefer to have his or her front boot more or less inclined in relation to his or her rear boot. Further, such a binding apparatus is, due to its construction, relatively heavy and complex and, consequently, onerous to manufacture.

SUMMARY OF THE INVENTION

It is therefore an object of the present invention to overcome the disadvantages of the known apparatus. To this end, the present invention is directed to a binding apparatus which includes:

(a) a first binding assembly for retaining a first boot on a ski and a second binding assembly for retaining a second boot on the ski;

(b) each of the binding assemblies having a longitudinally movable jaw for retaining an end of a respective one of the first and second boots;

(c) an energization mechanism for exerting a common biasing force on both of the movable jaws of each of the first binding assembly and the second binding assembly; and (d) means for linking the energization mechanism to each of the movable jaws of the first binding assembly and the second binding assembly.

According to one aspect of the invention, the energization mechanism is movable between an energized position, in which the movable jaw of each of the binding assemblies is maintained in a retention position, and a relaxed position, in which the movable jaw of each of the binding assemblies is movable to facilitate release of a respective one of the boots.

According to an additional aspect of the invention, each of the binding assemblies includes a fixed jaw longitudinally spaced from a respective one of the movable jaws, wherein the linking means includes a pair of elements operatively connected to respective ones of the movable jaws, and wherein the energization mechanism, in the energized position, exerts the common biasing force to each of the movable jaws to bias the movable jaws toward respective ones of the fixed jaws.

According to a still further aspect of the invention, the first binding assembly includes a front binding assembly adapted to be positioned at an acute angle with respect to a longitudinal plane of the ski, wherein the second binding assembly includes a rear binding assembly adapted to be positioned generally perpendicular to the longitudinal plane, and wherein the energization mechanism is positioned between the front binding assembly and the rear binding assembly.

Further according to the invention, each of the binding assemblies includes a fixed support plate and a movable support plate, and each of the movable jaws is mounted for movement with a respective one of the movable support plates.

Still further according to the invention, the linking means includes a flexible cable extending from each of the movable support plates, the flexible cables being attached to the energization mechanism.

More specifically according to the invention, each of the flexible cables includes a segment longitudinally extending away from a respective one of the movable jaws toward a respective one of the fixed jaws of a respective one of the binding assemblies for transmitting the biasing force from the respective movable jaw to a fixed jaw of a respective binding assembly for retaining a respective boot thereon.

According to an additional aspect of the invention, the energization mechanism includes a common elastic biasing element for exerting the common biasing force on the movable jaws through the linking means.

Additionally, the energization mechanism includes a bearing member and a support member between which the biasing element extends.

Still further, the linking means includes a first flexible cable connecting the bearing member and the movable jaw of the first binding assembly and a second flexible cable connecting the bearing member and the movable jaw of the second binding assembly.

More specifically, the energization mechanism includes a lever journalled for movement on the support member around a first transverse axis positioned on a predetermined plane and journalled on the bearing member, the lever being movable around the first axis from a relaxed position to an energized position, wherein, in the relaxed position, the second axis is positioned on one side of the plane and, in the energized position, the second axis is positioned on the other side of the plane.

In a particular embodiment of the invention, a respective sheath is provided covering each of the first flexible cable and the second flexible cable, each of the respective sheaths being affixed at one end on a fixed portion of a respective one of the binding assemblies and, at a second end, the sheath is adapted to be affixed to the ski.

It is an additional object of the present invention to provide a binding assembly for a ski including a fixed seat and a movable seat for supporting a boot, the fixed seat including a first jaw, for engaging one end of the boot, and a guide portion for guiding the movable seat longitudinally, the movable seat including a second jaw, for engaging a second end of the boot, means associated with the movable seat adapted for receiving a linkage for exerting a biasing retention force from the second jaw toward the first jaw.

In a particular aspect of the invention, the fixed seat includes a fixed support plate having a predetermined width and the guide portion, the guide portion including a central portion having a width less than the predetermined width of the fixed support plate, and wherein the movable seat includes a movable support plate and a pair of laterally spaced guided portions extending from the movable support plate, the guided portions being engaged with the central portion of the guide portion.

Further, the means for receiving a linkage includes a longitudinally extending groove located in the movable support plate within which the linkage is received and guided longitudinally toward the fixed support plate.

Still further, the invention includes a means for guiding the linkage transversely of the longitudinally extending groove for guiding the linkage toward an energization mechanism.

It is a still further object of the present invention to provide a binding apparatus including a front and a rear binding assembly for maintaining a front boot and a rear boot, respectively, in predetermined positions on the snowboard, the front and rear binding assemblies having respective longitudinally movable retention jaws, and means for linking the binding assemblies, wherein the front and rear binding assemblies are of the passive type, not including respective energizing means, wherein the linking means includes a common energizing mechanism positioned between the two binding assemblies and includes a central part having the common energizing mechanism, and a pair of flexible linking devices connecting the common energizing mechanism to the longitudinally movable retention jaws.

According to a specific aspect of the invention, each of the binding assemblies includes a seat, fixed to the snowboard, and a slide plate longitudinally movably mounted relative to the fixed seat, the fixed seat and the movable slide plate each having a generally rectangular form and constituting, respectively, a fixed support plate and a movable support plate for the sole of the respective boot, the fixed support plate and the movable support plate having respective ends which carry, respectively, a fixed jaw and a movable jaw.

More specifically according to the invention, the fixed support plate of each of the binding assemblies extends towards the movable support plate and includes a central longitudinal slide rail which is narrower and thinner than the fixed support plate for guiding the movable slide plate longitudinally.

Still further according to the invention, the movable support plate of each of the binding assemblies has a lower portion which forms a single piece having two laterally opposed guiding portions adjacent the fixed central slide plate, the movable support plate thereby being generally U-shaped open towards the fixed seat, the laterally opposed guiding portions having longitudinally extending internal sides and the slide rail having longitudinally extending sides which include, respectively, complementary ribs and grooves for engagement with each other to ensure the guiding of the movable support plate on the fixed slide rail.

According to a still further aspect of the invention, the fixed support plate and the slide rail include longitudinally elongated slots, positioned symmetrically with respect to a longitudinal axis of the binding assembly, and wherein the fixed seat is adapted to be affixed to the snowboard by means of one or more screws positioned within the slots.

In a still additional aspect of the invention, the fixed support plate of each binding assembly has a front edge extending upwardly from a front portion of the fixed support plate and forming a single piece with the front portion of the fixed support plate, wherein the fixed jaw of each binding assembly is mounted on the front edge, the fixed jaw including a sole grip vertically adjustably mounted on the front edge of the fixed support plate by means of a screw extending through a vertical slot formed in the vertical edge of the fixed support plate and being held in a threaded hole provided in the vertical edge of the fixed support plate.

In a still further aspect of the invention, the movable jaw of each of the binding assemblies carries an upper horizontal roller rotatably mounted around a generally horizontal and transverse axis in a hollow provided in the movable jaw, the horizontal roller being adapted to rest upon the upper edge of the sole of the boot, and the movable jaw further carrying, below the upper horizontal roller and on either lateral side of the horizontal roller, a respective vertical roller, the vertical rollers being rotatably mounted around respective vertical axes and which are adapted to rest against lateral surfaces of the sole of the shoe.

In a still further aspect of the invention, the movable support plate has an upper surface having a plurality of longitudinally spaced transversely extending notches communicating longitudinally between themselves by means of a central groove, wherein the pair of flexible linking devices includes a pair of flexible traction cables, each cable having a head at an end of the cable, the end being selectively housed and retained in one of the several transverse notches, and a longitudinally extending segment located within the central groove, and wherein the slide plate is biased in the direction of the fixed seat by means of a respective one of the flexible traction cables connected to the energizing mechanism.

More specifically according to the invention, each of the notches are formed, in a vertical longitudinal cross-section, generally in the general shape of a V, which is slightly inclined rearwardly for facilitating the retention of the head of the respective cable in the notch in which it is housed.

In another specific feature of the present invention, each of the flexible traction cables extends from the common energizing mechanism and is introduced transversely in a respective one of the binding assemblies, wherein the flexible traction cable then is deviated to form the longitudinal segment, wherein each of the binding assemblies includes a projection spaced from a front face of the fixed support plate to thereby define, on either side of the longitudinal axis of the binding assembly, a passage for the guiding of the cable as the cable is transversely introduced in the binding assembly, thereby bending the cable on one of two front faces of the projection within a respective one of the passages, the projection having in an axial central part, an axial hole through which a cable passes, after having been deviated on one of the front faces of the projection, the cable then extending towards the movable jaw while forming the longitudinal segment.

In a still further specific feature of the present invention, the flexible linking devices includes two flexible traction cables operatively affixed, at one of their respective ends, to the movable jaws of the binding assemblies and, at a second of their respective ends, to the common energizing mechanism, the common energizing mechanism further including a bearing member containing a spring and which exerts equal and opposite traction forces on the two cables through portions of the common energizing mechanism, the apparatus further including a booting and de-booting lever journalled on the bearing member and movable between a booting position, in which the lever extends in a generally horizontal position, in which position the portions of the common energizing mechanism and the spring compress the spring and tension the traction cables, and a de-booting position, in which the lever extends toward a perpendicular position, in which position the portions of the common energizing mechanism and the spring de-compress the spring and relax the traction cables.

Still further according to the present invention, the bearing is elongated in the longitudinal direction of the snowboard and in the direction of the two cables, wherein the bearing is open towards the bottom and is closed on one end by a transverse wall, the transverse wall having a hole through which a first threaded shaft extends, the transverse wall having an inside wall, wherein the first threaded shaft has a head which rests against the inside wall of the transverse wall, an internally threaded socket, the socket having, opposite of the first threaded shaft, a wall having a hole through which a first one of the traction cables extend, the wall of the socket serving to retain a head affixed to the end of the first cable, wherein a second shaft has a head which is adjacent the head of the first shaft, wherein the second shaft extends from its head along the longitudinal axis of the first shaft, wherein the common energizing mechanism further includes a support adapted to be fixed to the snowboard for supporting a forward portion of the bearing, which covers the support, the support having a vertical wing having an opening through which the second shaft extends, the support having a surface against which an end of the spring is supported, the spring surrounding the second shaft, the support further including a horizontal lower wing which is adapted to rest on the upper surface of the snowboard, while being adapted to slide thereon to a predetermined extent, the second shaft extending from the support outside of the bearing and having a threaded part upon which a second socket is threaded, the second socket having a wall through which a second of the traction cables extends, the second cable having a head located within the second socket for retaining the second cable.

According to another aspect of the present invention, the booting and de-booting lever is journalled on the support around a generally horizontal and transverse axis, and is journalled to the bearing around a second generally horizontal and transverse axis, wherein, in a booting position, the booting and de-booting lever extends generally horizontally and the second axis is located below the first axis, during which the spring is compressed, between the head of the second shaft and the surface of the support which it biases towards the second traction cable.

According to a still further aspect of the invention, the vertical wing of the support ends in an upper vertical finger engaged in a longitudinal elongated slot formed in a horizontal upper wall of the bearing.

Still further according to the invention, the horizontal lower wing of the support includes a longitudinally elongated slot through which a screw is adapted to extend and be fixed into the snowboard without fixing the support against movement longitudinally, such that the support is slidable along a distance which is limited by two ends of the longitudinal slot coming into contact with the screw.

Further according to the invention, the pair of flexible linking devices includes two flexible traction cables which are hooked, in each of the binding assemblies to a support plate including part of a movable rear slide plate which is associated with the movable rear jaw which is biased towards the front, in the direction of the front fixed jaw.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

The present invention has as an objective to overcome the disadvantages of the known apparatus described above.

To this end, the binding apparatus of the present invention includes, for a pair of boots of a skier for a snow surf board, two individual binding assemblies designed to maintain, respectively, the front and rear boots in predetermined positions on the snowboard, and means for linking the two individual binding assemblies. Both of the front and rear binding assemblies are of the passive type, that is, they do not themselves include individual biasing or energizing means. Instead, they are linked to each other through the means of a common energizing apparatus placed between the two binding assemblies. The energizing apparatus includes, in its central part, an energizing mechanism which is linked, through the means of respective flexible linking devices, to movable parts of the two individual binding assemblies, which constitute retention jaws and which are movable in the longitudinal direction of each binding assembly.

Figure 1:
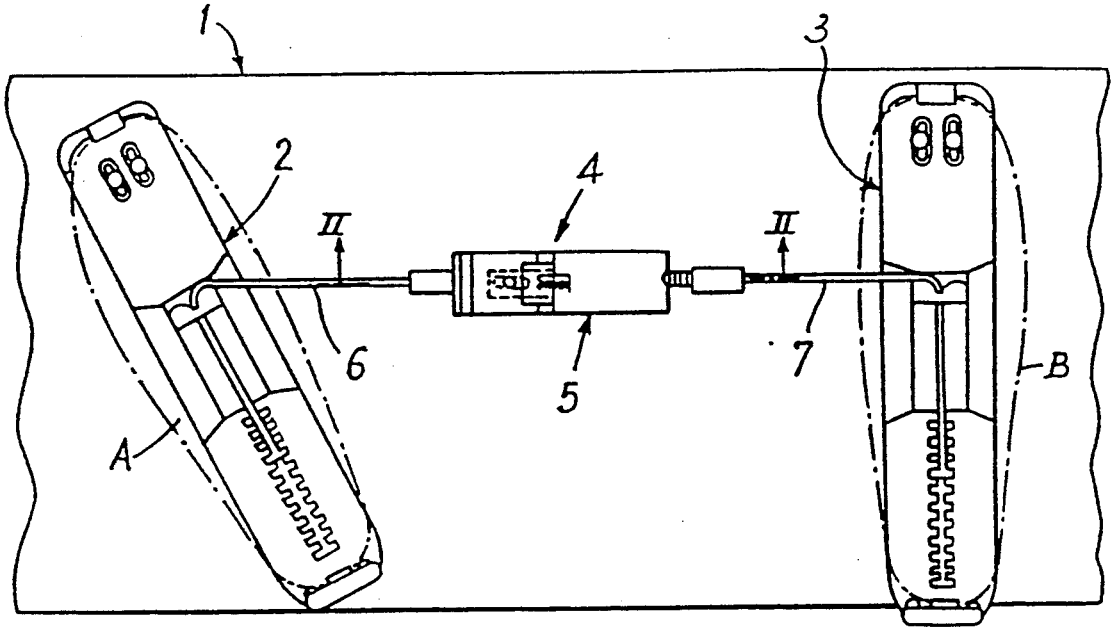
FIG. 1 is a partial plan view of a snowboard on which front and rear boots are maintained by means of a binding apparatus according to the invention.

With regard to the drawings, FIG. 1 shows a snowboard, or surf board 1, on which is maintained, by the means of two respective individual binding devices 2 and 3, a front boot A and a rear boot B, shown in phantom lines. The front boot A is mounted on the surf board 1 in an inclined position towards the front in relation to the longitudinal axis of the board 1, while the rear boot B extends transversely, that is, perpendicularly to the longitudinal axis. However, these orientations are not limiting and the boots could be made to have other orientations.

The two binding assemblies, front 2 and rear 3, are of the passive type, that is, they do not themselves include individual energizing means, and they are linked to each other through the means of a common energizing device 4 placed between the two binding assemblies. The apparatus 4 includes, in its central part, an energizing mechanism, extending in the longitudinal direction of the surf board 1 and which is linked through the means of two respective flexible traction cables, front 6 and rear 7, to movable parts of the two individual binding assemblies 2, 3, which constitute retention jaws, movable in the longitudinal direction, of each binding assembly 2, 3.

Since the two individual binding assemblies, front 2 and rear 3, are manufactured in the same way, only one of them, namely the individual binding assembly 3 for the rear boot B, will be described in detail. The rear binding assembly 3 includes essentially two elements, namely, a front seat 8 affixed to the surf board and a rear slide seat on plate 9 longitudinally movably mounted on the front fixed seat 8. The front seat 8 and the rear slide plate 9 have an overall rectangular form, and they constitute, respectively, a fixed support plate 10 and a movable support plate 11 for the sole of the boot B. The front and rear ends of the boot are respectively retained by vertical wings forming retention jaws, namely, a fixed front jaw 12 and a movable rear jaw 13. The fixed front jaw 12 is mounted on a front vertical edge 10*a*, extending upwardly from the front edge of the front support plate 10 and forming a single piece with this support plate. On the vertical edge 10*a*, there is affixed, at an adjustable height, a sole-grip 12*a* in the shape of an angle iron. The sole grip 12*a* is immobilized in a way that its horizontal wing, extending towards the rear jaw 13, rests on the front and upper edge of the sole of the boot B. In the illustrated embodiment, this immobilization is accomplished by means of a screw 14, extending through a vertical slot 15 formed in the vertical wing of the sole grip 12*a* and screwed into a threaded hole provided in the edge 10*a*.

The support plate 10 for the front part of the sole of the boot is relatively broad and it extends towards the rear, that is, towards the movable slide plate 9, by a central longitudinal part 16 which is narrower and thinner than the support plate 10 of the front seat 8, and which constitutes a means for guiding the slide plate 9 in its longitudinal movement. Seat 8 is affixed on the surf board 1 by means of screws 17, 17*a* traversing elongated longitudinal slots formed, respectively, in the support plate 10 and the guide rail 16, symmetrically in relation to the longitudinal axis xy of the binding assembly. The screws 17 and the slots 18 are situated near the front vertical edge 10*a*, while screws 17*a* and the slots 18*a* are located in the lower part of slide rail 16. The seat 8 can, therefore, be affixed to the surf board 1 in a variable position in a longitudinal direction, to appropriately accommodate the length of the boot which is to be maintained on the surf board 1.

Figure 4:
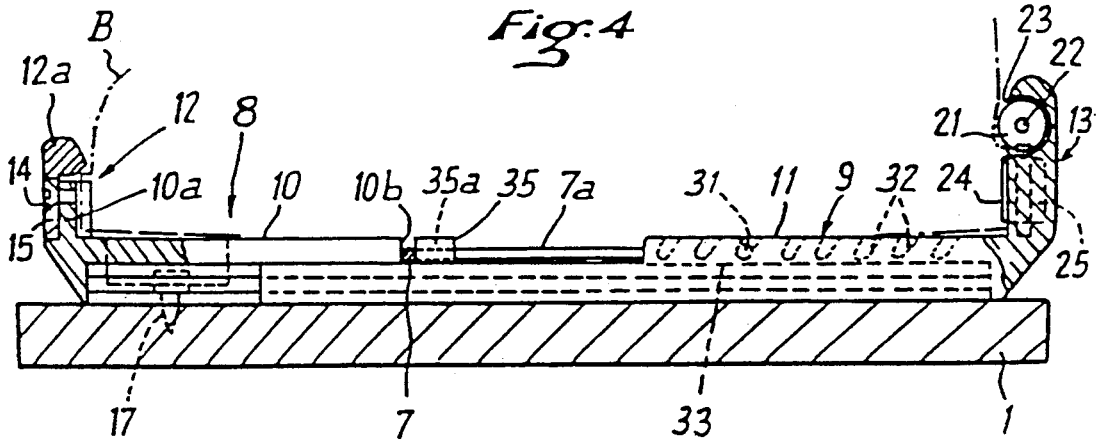
FIG. 4 is a cross-sectional side elevation view taken at line IV—IV of FIG. 3.

The slide plate 9 includes, in its upper and rear part, the horizontally disposed movable support plate 11, having a generally rectangular form, and which forms a single piece at its rear end, having a vertical and transverse wing constituting the movable rear jaw 13. The movable rear jaw 13 carries an upper horizontal roller 21, rotatably mounted around a horizontal and transverse axis 22, in an upper hollow 23, which is formed on the vertical front side of the rear movable jaw 13, while opening into the front. The rear jaw 13 also carries, below the upper horizontal roller 21 and on both sides of the roller, two vertical rollers 24, 25, which are rotatably mounted around respective vertical axes 26, 27, and which are housed in corresponding hollows, open toward the front, formed in the rear side of the vertical jaw 13. The upper horizontal roller 21 is intended to come to rest on the upper edge of the rear end of the sole of the boot B, as is shown on FIG. 4, while the two vertical and lateral rollers 24, 25 are intended to come in contact with the lateral surface of the sole, in order to ensure the maintenance of the heel of the boot.

Figure 5:
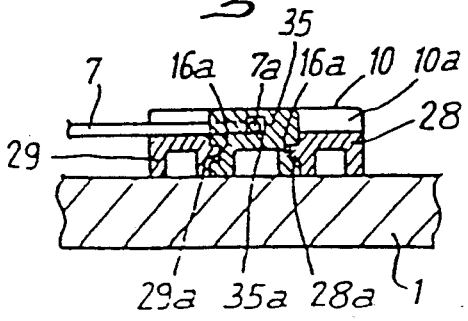
FIG. 5 is a cross-sectional end elevation view taken along line V—V of FIG. 3.
Figure 6:
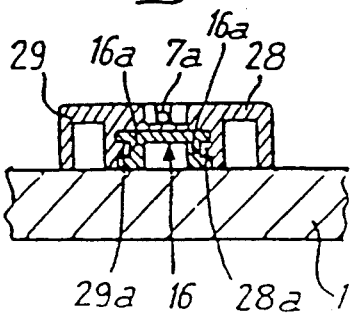
FIG. 6 is a cross-sectional end elevation view taken along line VI—VI of FIG. 3.

The support plate 11 of the rear slide plate 9 forms a single piece, at its lower part, with two laterally opposed, but longitudinally forwardly extending, guiding portions 28, 29, and which are adjacent to the central slide rail 16 which is part of the seat 8 on either side of the slide rail 16. Therefore, at its lower level, the rear slide plate 9 has a generally U-shape which is forwardly open. The longitudinal internal sides of the lateral guiding portions 28, 29 of slide plate 9, and the longitudinal exterior sides of the central slide rail 16, are made in a way to nest in each other, to ensure the longitudinal guiding, as it appears more particularly in FIGS. 5 and 6. For example, the internal sides of the lateral guiding portions 28, 29 can include respective ribs 28*a*, 29*a*, extending longitudinally and horizontally, projecting towards the interior, the ribs 28*a*, 29*a* being engaged in longitudinal corresponding grooves 16*a* formed in the two lateral exterior faces of the central slide rail 16. The opposite configuration could be equally be adopted, that is, with the longitudinal ribs provided on the central slide rail 16, and the grooves on the lateral guiding portions 28, 29.

The slide plate 9 is biased towards the front, in the direction of the fixed seat 8, by means of a flexible rearwardly extending cable 7, which ends in a head 31, which is affixed to the rear end of the cable. The head 31, which extends transversely, can be housed and retained in one of the several transverse notches 32, which are formed in the upper side of the movable support plate 11, and which are spaced apart from each other along the longitudinal axis xy of the binding assembly. The notches 32, preferably, have a cross-section, in a vertical plane, in the general form of a V, which is slightly inclined in the opposite direction to the direction in which the traction force is exerted, that is, from the bottom to top and from front to rear, respectively, as appears more clearly in FIG. 4, in order to firmly retain the head 31 of the cable 7 in the notch 32 in which it is housed, when a traction force is directed towards the front on cable 7. The various notches 32 communicate between themselves by a central groove 33 in which an external longitudinal segment 7*a* of cable 7 extends, starting from rear head 31.

Figure 3:
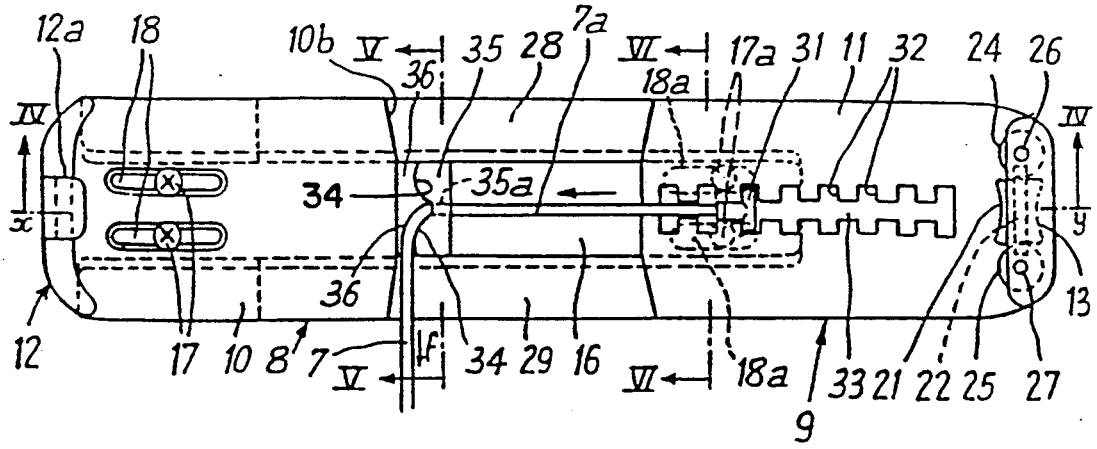
FIG. 3 is a plan view of the whole of the individual binding which ensures the retention of the rear boot on the snowboard.

As appears more particularly in FIGS. 1 and 3, the flexible cable 7 penetrates transversely in the entirety of the individual rear binding assembly 3, while being nearly perpendicular to the assembly on the side facing towards the central energizing mechanism 5. Cable 7 extends toward the rear face 10*b* of the support plate 10 of seat 8 and the cable then turns by 90 degrees towards the rear, to form the longitudinal segment 7*a*, while being maintained on a curved support surface 34. The curved surface 34 constitutes a part of the front face of a projection 35 rearwardly spaced from rear face 10*b* of the support plate 10 in order to define, on both sides of the longitudinal axis xy, two passages 36, for the guiding of cable 7 at its entry in the individual binding assembly 3. The projection 35, which is symmetrical in relation to the longitudinal axis xy has an axial hole 35*a* in its central and rear part through which cable 7 passes, after having been deviated by 90 degrees on one of the support surfaces 34, cable 7 extending then towards the movable jaw 13 while forming the longitudinal segment 7*a*. The angle of deviation of cable 6 or 7, in the individual binding assembly 2 or 3, respectively, is in fact variable and it depends on the relative position of the binding assembly and of the energizing mechanism.

According to the preceding description, it can be seen that a traction force exerted on the cable 7 directed towards the exterior of the binding device, that is, inwardly toward the other binding device, in the direction of arrow f in FIG. 3, creates a traction force on the longitudinal segment 7*a* of cable 7 towards the front, such that the slide plate 9 and the rear jaw 13 are biased towards the front, therefore elastically maintaining the sole of the boot B between the front jaws 12 and rear 13.

In the front binding assembly 2, the flexible cable 6 extends transversely of this assembly and it is deviated towards the rear movable jaw 13, while forming an acute angle, due to the inclination of the assembly 2 towards the front.

Figure 2:
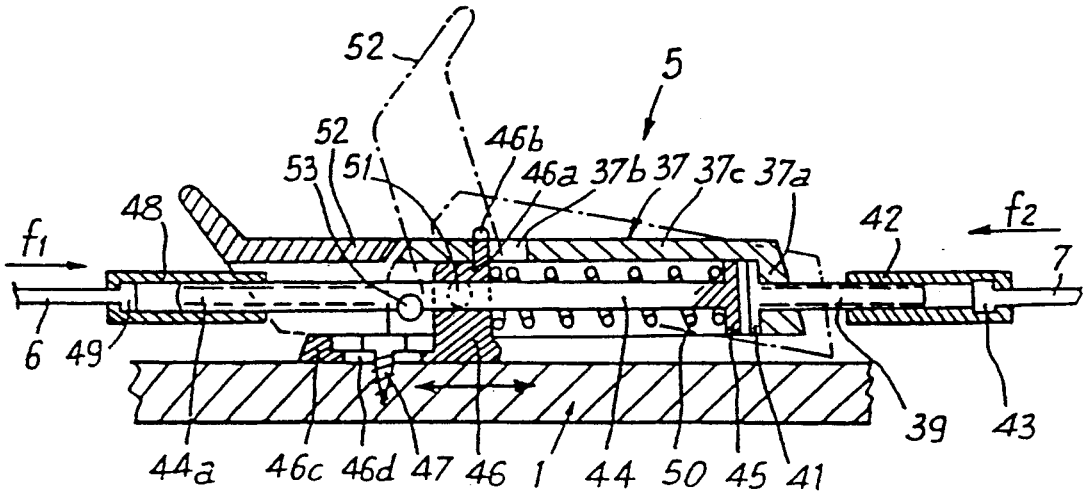
FIG. 2 is a cross-sectional side elevation view, on a larger scale, taken at line II—II of FIG. 1.

With particular reference to FIG. 2, a non-limiting embodiment of the energizing mechanism 5 to which the two flexible cables 6, 7 are connected will now be described. The energizing mechanism 5 includes a horizontal bearing member 37, extending in the longitudinal direction of both the surf board 1 and of the two cables 6, 7, and which is downwardly opened and which is closed towards the top by an upper wall and closed towards the rear, that is, positioned on the side of cable 7, by transverse wall 37*a*. A threaded shaft 39 extends through the rear wall 37*a* and, inside bearing member 37, the shaft 39 has a head 41 which rests against the inside face of the rear wall 37*a*. A threaded socket 42 is positioned on the threaded shaft 39 and includes a wall pierced by a hole through which cable 7 extends and which serves to retain a head 43 affixed to the end of cable 7. Socket 42 permits, therefore, the adjustment of the distance between the threaded shaft 39 and the head 43 of cable 7 and, consequently, enables the variation of the tension of the cable, as will be further discussed below.

Within the interior of the bearing member 37 extends, in the axis of the threaded shaft 39, a second shaft 44 which carries, at its rear end, closely adjacent the head 41 of shaft 39, a rear head 45. The shaft 44 extends through a horizontal and longitudinal hole of a support 46 carried by the surf board 1 and which serves as a support for the front part of bearing member 37 which covers it. The support 46 includes a vertical wing 46*a* which is horizontally crossed by shaft 44 and whose rear side, that is, the one which is located on the side of head 45 of the second shaft 44, serves as a support for an end of an axial compression spring 50, which surrounds shaft 44 and which rests, at its other end, on head 45 of the second shaft 44. The vertical wing 46*a* of support 46 ends in an upper vertical finger 46*b* engaged in a longitudinally elongated slot 37*b* formed in the upper horizontal wall 37*c* of bearing member 37.

The support 46 also includes a lower horizontal wing 46*c* which extends forwardly and which rests on the upper surface of the surf board 1, while being able to glide, within a limited range, on this surface. To this end, the lower horizontal wing 46*c* of support 46 is pierced by a slot 46*d* elongated in the longitudinal direction of bearing member 37, that is, parallel to shafts 39 and 44, and through the slot 46*d* extends a screw 47 which is screwed in the surf board 1, without blocking support 46. The support 46 can, therefore, slide within a distance which is limited by the two ends of the longitudinal slot 46*d* which come into contact with screw 47.

Shaft 44 projects forwardly from bearing member 37 and it ends in a threaded part 44*a* on which a screw socket 48 is received. The socket 48 includes a front wall having a hole for the passage of the cable 6 which ends, at the inside of socket 48, by a head 49 which rests against the wall of socket 48.

On the support 46, a booting and de-booting lever 52 is supported, being journalled thereon by two coaxial pins or axles which extend transversely from opposite portions of the support 46 along transverse axis 51. Also, the lever 52 is linked to the front part of bearing member 37, that is, the one which covers support 46, around a transverse axis 53, constituted by a pair of axles engaged respectively in the two lateral walls of bearing 37.

In the booting position, in which the constituent elements of the energizing mechanism 5 occupy the positions represented in solid lines in FIG. 2, the booting and de-booting lever 52 extends horizontally and it extends towards the front of the bearing member 37. The journal axis 53 between the lever 52 and bearing member 37 is situated in front and slightly below the journal axis 51 of lever 52 on support 46. The spring 50 is therefore compressed between the rear head 45 of the second shaft 44 and the rear face of support 46, which it biases towards the front, that is, towards the front cable 6. This force towards the front is transmitted by support 46 to axis 51, then by this axis 51 to bearing member 37. This horizontal stress then exerts itself on its end towards the front in a horizontal plane situated above axis 53 and it is translated, consequently, by a link biasing the lever 52 in a counterclockwise direction, so that the lever 52 is maintained in a horizontal position under the action of a compressed spring 50.

The adjusting sockets 42, 48 are adjusted in a way to obtain, for support 46 and the energizing mechanism assembly 5, a position of equilibrium in which screw 47 is located in the middle of slot 46*d*. The compression spring 50 biases head 45 and, consequently, shaft 44 towards the rear, which has the effect of exerting on cable 6 a traction force directed towards the rear, indicated by arrow fl in FIG. 2. As the compression spring 50 takes hold, besides, on the rear side of support 46, the support 46 is biased towards the front, as is the lever 52 which is linked to it by the transverse journal axis 51. In its turn, lever 52 transmits this force towards the front of bearing 37 by means of its journal axis 53. Bearing 37 is thusly biased towards the front, by means of its rear wall 37*a*, head 41 of shaft 39 and cable 7, which is therefore submitted to a traction force towards the front, indicated by arrow f2 in FIG. 2. Due to the construction of the energizing mechanism 5, there exists, consequently, a state of equilibrium in which the traction forces f1, f2 are equal but are oppositely directed. The traction forces are transmitted, respectively, by cables 6, 7 to the rear slide plate 9 of the individual binding assemblies 2 and 3, in order to elastically bias the slide plates 9 and, consequently, the rear jaws 13 in the direction of the front jaws 12.

When the skier wishes to de-boot, he or she raises the booting and de-booting lever 52 and makes it pivot in a clockwise direction in FIG. 2, to lead it to the substantially vertical position represented in phantom lines. Following this pivoting movement of lever 52, the journal axis 53 between lever 52 and bearing member 37 becomes positioned above the journalling axis 51 such that the bearing member 37 is raised in its front part and takes an inclined position from top to bottom and from front to rear, as is shown in dotted lines in FIG. 2. Due to the fact that the journal axis 53 of lever 52 on bearing member 37, is located above journal axis 51 of lever 52 on support 46, the support 46 is no longer retained axially, as is the case in the booting position, such that it can be pushed towards the front by spring 50. The spring is then relaxed, which leads to the elimination of the traction forces on the two cables 6 and 7. The rear jaw 13 is no longer biased towards the front jaw 12 and the skier can disengage his of her front boot A and rear boot B of the respective individual binding assemblies 2 and 3.

When the skier wishes to put on the boots again, he or she engages the boots A, B, between the front jaw 12 and the rear jaw 13 of the two individual assemblies 2, 3 while applying the soles of his boots in a horizontal position on the respective support plates. Then the lever 52 is made to pivot in a counter-clockwise direction in FIG. 2, from its vertical position to its horizontal position extending towards the front. This pivoting movement has the effect of making the journalling axis 53 pass in front of and lower than the journalling axis 51, which leads again to a compression of spring 50 and an elastic locking of lever 52 in its booting position in a horizontal position on the surf board 1.

If, during the practice of surfing, following an excessive biasing force exerted by one of the boots A, B on the respective binding assembly 2, 3, the binding assembly releases, releasing the corresponding boot, the associated cable 6, 7 itself immediately relaxing, this relaxation being transmitted, by means of the energizing mechanism 5, to the other flexible cable, which leads then to the release of the other individual binding assembly. Then, when, in the case of a fall, one of the boots A, B escapes, the individual associated binding assembly 2, 3, following a force in excess of the release threshold, the other boot is automatically freed. The magnitude of the release threshold can be adjusted, for the two individual binding assemblies 2, 3, while screwing more or less onto the screw sockets 42, 48 on the associated threaded shafts 39, 44.

Although in the preceding description, we had indicated that the energizing mechanism 5 was tied, by the flexible cables 6, 7 to the rear movable jaws 13 f the two individual binding assemblies 2, 3, it would be equally possible, following a variation of embodiment of the binding apparatus according to the invention, to tie the cables to the front jaws 12. In this case, the front jaws 12 would be longitudinally movably mounted in relation to the rear parts of the individual binding assemblies 2, 3, affixed permanently to surf board 1. This placement would demand a different guiding of the flexible cables 6, 7 since these would need to be directed, during their entry in the individual binding assemblies 2, 3 towards the front in the direction of the front jaws 12, in order to bias the movable front jaws 12 towards the rear, in the direction of the rear fixed jaws 13.

Figure 7:
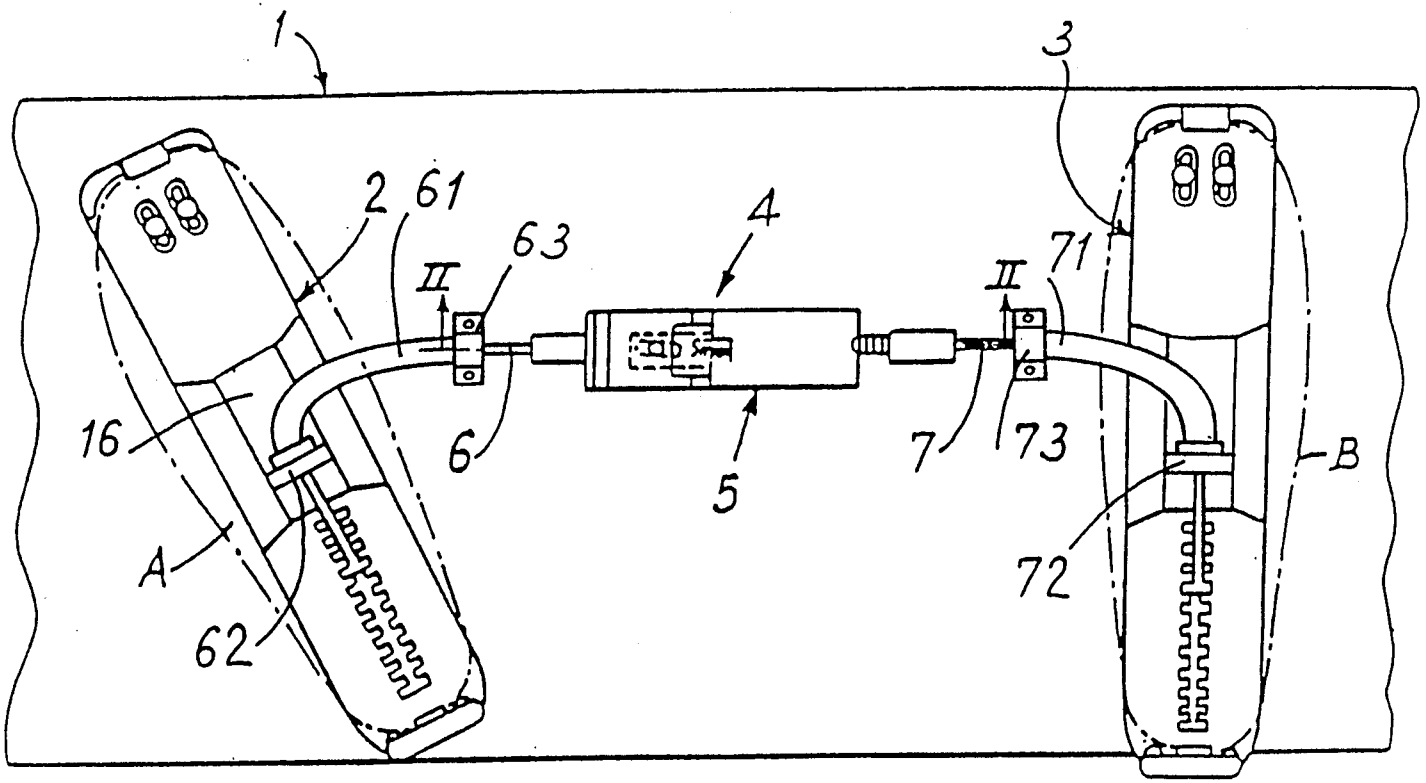
FIG. 7 illustrates a variation of the invention, shown in plan view.

FIG. 7 illustrates a variation of the invention, according to which the flexible cables 6, 7 are guided in a respective flexible sheath. The ends of sheaths 61 and 71 rest against stops that the cable crosses. That is, sheath 61 rests at one of its ends against a support 62, associated with the central slide 16 of binding 2. The other end of the sheath 61 rests against a stop 63 associated directly or indirectly with the surf board 1. In the same way, sheath 71 rests by each of its ends against support 72 and stop 73. The functioning of the binding is the same as what had been previously described.

Finally, although the invention has been described with reference of particular means, materials and embodiments, it is to be understood that the invention is not limited to the particulars disclosed and extends to all equivalents within the scope of the claims.

What is claimed is:

1. A binding apparatus comprising:

(a) a first binding assembly comprising means for retaining a first boot on a ski and a second binding assembly comprising means for retaining a second boot on the ski;

(b) each of said binding assemblies having a respective longitudinally movable jaw for retaining an end of a respective one of said first and second boots and respective means for mounting said respective jaws for longitudinal movement;

(c) an energization mechanism for exerting a common biasing force on both of said movable jaws of each of said first binding assembly and said second binding assembly; and (d) means for linking said energization mechanism to each of said movable jaws of said first binding assembly and said second binding assembly, said means for linking comprising means for exerting said common biasing force to said first binding assembly in a first direction and means for biasing said common biasing force to said second binding assembly in a second, opposite direction.

2. The apparatus of claim 1, further comprising means for enabling movement of said energization mechanism between an energized position, in which said movable jaw of each of said binding assemblies is maintained in a retention position, and a relaxed position, in which said movable jaw of each of said binding assemblies is movable to facilitate release of a respective one of said boots.

3. The apparatus of claim 2, wherein each of said binding assemblies comprises a fixed jaw longitudinally spaced from a respective one of said movable jaws, therein said linking means comprises a pair of elements operatively connected to respective ones of said movable jaws, wherein said energization mechanism, in said energized position, exerts said common biasing force to each of said movable jaws to bias said movable jaws toward respective ones of said fixed jaws.

4. The apparatus of claim 1, wherein said energization mechanism comprises at least a single common elastic biasing element for exerting said common biasing force on both of said movable jaws through said linking means.

5. The apparatus of claim 4, wherein said energization mechanism comprises a bearing member and a support member between which said biasing element extends.

6. A binding apparatus comprising:

(a) a first binding assembly comprising means for retaining a first boot on a ski and a second binding assembly comprising means for retaining a second boot on the ski;

(b) each of said binding assemblies having a respective longitudinally movable jaw for retaining an end of a respective one of said first and second boots and respective means for mounting said respective jaws for longitudinal movement;

(c) an energization mechanism for exerting a common biasing force on both of said movable jaws of each of said first binding assembly and said second binding assembly; and (d) means for linking said energization mechanism to each of said movable jaws of said first binding assembly and said second binding assembly, wherein said first binding assembly comprises a front binding assembly adapted to be positioned at an acute angle with respect to a longitudinal plane of said ski, wherein said second binding assembly comprises a rear binding assembly adapted to be positioned generally perpendicular to said longitudinal plane, and wherein said energization mechanism is positioned between said front binding assembly and said rear binding assembly.

7. A binding apparatus comprising:

(a) a first binding assembly comprising means for retaining a first boot on a ski and a second binding assembly comprising means for retaining a second boot on the ski;

(b) each of said binding assemblies having a respective longitudinally movable jaw for retaining an end of a respective one of said first and second boots and respective means for mounting said respective jaws for longitudinal movement;

(c) an energization mechanism for exerting a common biasing force on both of said movable jaws of each of said first binding assembly and said second binding assembly; and (d) means for linking said energization mechanism to each of said movable jaws of said first binding assembly and said second binding assembly, wherein each of said binding assemblies comprises a fixed support plate and a movable support plate, wherein each of said movable jaws is mounted for movement with a respective one of said movable support plates.

8. The apparatus of claim 7, wherein said linking means comprises a flexible cable extending from a connection point at each of said movable support plates, said flexible cables being attached to said energization mechanism.

9. The apparatus of claim 8, wherein each of said flexible cables comprises a segment longitudinally extending away from a respective one of the movable jaws toward a respective one of said fixed support plates of a respective one of said binding assemblies for transmitting said biasing force from said respective movable jaw to a fixed jaw of a respective binding assembly for retaining a respective boot thereon.

10. A binding apparatus comprising:

(a) a first binding assembly comprising means for retaining a first boot on a ski and a second binding assembly comprising means for retaining a second boot on the ski;

(b) each of said binding assemblies having a respective longitudinally movable jaw for retaining an end of a respective one of said first and second boots and respective means for mounting said respective jaws for longitudinal movement;

(c) an energization mechanism for exerting a common biasing force on both of said movable jaws of each of said first binding assembly and said second binding assembly; and (d) means for linking said energization mechanism to each of said movable jaws of said first binding assembly and said second binding assembly, wherein said energization mechanism comprises at least a single common elastic biasing element for exerting said common biasing force on both of said movable jaws through said linking means, and a bearing member and a support member between which said biasing elements extends, and wherein said linking means comprises a first flexible cable connecting said bearing member and said movable jaw of said first binding assembly and a second flexible cable connecting said bearing member and said movable jaw of said second binding assembly.

11. The apparatus of claim 10, wherein said energization mechanism comprises a lever journalled for movement on said support member around a first transverse axis positioned on a predetermined plane and journalled on said bearing member wherein said lever is movable around said first axis from a relaxed position to an energized position, wherein, in said relaxed position, said second axis is positioned on one side of said plane and, in said energized position, said second axis is positioned on the other side of said plane.

12. The apparatus of claim 10, further comprising a respective sheath covering each of said first flexible cable and said second flexible cable, each of said respective sheaths being affixed at one end on a fixed portion of a respective one of said binding assemblies and, at a second end, the sheath is adapted to be affixed to the ski.

13. A binding assembly for a ski comprising a fixed seat, adapted to be affixed to the ski, and a movable seat, adapted to be movable with respect to the ski, said fixed seat and said movable seat being adapted to support a boot, said fixed seat comprising a first jaw, for engaging one end of the boot, and a guide portion comprising means for guiding said movable seat longitudinally with respect to said fixed seat, said movable seat comprising a second jaw, for engaging a second end of the boot, said movable seat comprising means for receiving a linkage for exerting a biasing retention force from said second jaw toward said first jaw, wherein said fixed seat comprises a fixed support plate having a predetermined width and said guide portion, said guide portion comprising a central portion having a width less than said predetermined width of said fixed support plate, and wherein said movable seat comprises a movable support plate and a pair of laterally spaced guided portions extending from said movable support plate, said guided portions being engaged with said central portion of said guide portion.

14. The binding assembly of claim 13, wherein said means associated with said movable seat adapted for receiving a linkage comprises a longitudinally extending groove located in said movable support plate within which said linkage is received and guided longitudinally toward said fixed support plate.

15. The binding assembly of claim 14, further comprising means for guiding said linkage transversely of said longitudinally extending groove.

16. A binding apparatus for a snowboard including a front and a rear binding assembly for maintaining a front boot and a rear boot, respectively, in predetermined positions on the snowboard, the front and rear binding assemblies having respective retention jaws, and means for mounting said retention jaws for longitudinal movement with respect to the snowboard, and means for linking the binding assemblies, wherein the linking means includes a common energizing mechanism positioned between the two binding assemblies and comprises a central part having the common energizing mechanism, and a pair of flexible linking devices connecting the common energizing mechanism to the longitudinally movable retention jaws.

17. The apparatus according to claim 16, wherein each of the binding assemblies includes a seat, fixed to the snowboard,, a slide plate, and means for mounting said slide plate for longitudinal movement relative to the fixed seat, the fixed seat and the movable slide plate each having a generally rectangular form and constituting, respectively, a fixed support plate and a movable support plate for the sole of the respective boot, the fixed support plate and the movable support plate having respective ends which carry, respectively, a fixed jaw and a movable jaw.

18. The apparatus according to claim 17, wherein the fixed support plate of each of the binding assemblies extends towards the movable support plate and includes a central longitudinal slide rail which is narrower and thinner than the fixed support plate for guiding the movable slide plate longitudinally.

19. The apparatus according to claim 18, wherein the movable support plate of each of the binding assemblies has a lower portion which forms a single piece having two laterally opposed guiding portions adjacent the fixed support plate, the movable support plate thereby being generally U-shaped and open towards the fixed seat, the laterally opposed guiding portions having longitudinally extending internal sides and the slide rail having longitudinally extending sides which include, respectively, complementary ribs and grooves for engagement with each other to ensure the guiding of the movable support plate on the fixed support plate.

20. The apparatus according to claim 18, wherein the fixed support plate and the slide rail include longitudinally elongated slots, positioned symmetrically with respect to a longitudinal axis of the binding assembly, and wherein the fixed seat is adapted to be affixed to the snowboard by means of at least one screw positioned within the slots.

21. The apparatus according to claim 19, wherein the fixed support plate and the slide rail include longitudinally elongated slots, positioned symmetrically with respect to a longitudinal axis of the binding assembly, and wherein the fixed seat is adapted to be affixed to the snowboard by means of at least on screw positioned within the slots.

22. The apparatus according to claim 17, wherein the fixed support plate of each binding assembly has a front edge extending upwardly from a front portion of the fixed support plate and forming a single piece with the front portion of the fixed support plate, wherein the fixed jaw of each binding assembly is mounted on the front edge, the fixed jaw including a sole grip vertically adjustably mounted on the front edge of the fixed support plate by means of a screw extending through a vertical slot formed in the sole grip and being held in a threaded hole provided in the vertical edge of the fixed support plate.

23. The apparatus according to claim 18, wherein the fixed support plate of each binding assembly has a front edge extending upwardly from a front portion of the fixed support plate and forming a single piece with the front portion of the fixed support plate, wherein the fixed jaw of each binding assembly is mounted on the front edge, the fixed jaw including a sole grip vertically adjustably mounted on the front edge of the fixed support plate by means of a screw extending through a vertical slot formed in the the sole grip and being held in a threaded hole provided in the vertical edge of the fixed support plate.

24. The apparatus according to claim 19, wherein the fixed support plate of each binding assembly has a front edge extending upwardly from a front portion of the fixed support plate and forming a single piece with the front portion of the fixed support plate, wherein the fixed jaw of each binding assembly is mounted on the front edge, the fixed jaw including a sole grip vertically adjustably mounted on the front edge of the fixed support plate by means of a screw extending through a vertical slot formed in the the sole grip and being held in a threaded hole provided in the vertical edge of the fixed support plate.

25. The apparatus according to claim 17, wherein the movable jaw of each of the binding assemblies carries an upper horizontal roller rotatably mounted around a generally horizontal and transverse axis in a hollow provided in the movable jaw, the horizontal roller being adapted to rest upon an upper edge of a sole of a boot, and the movable jaw further carrying, below the upper horizontal roller and on either lateral side of the horizontal roller, a respective vertical roller, the vertical rollers being rotatably mounted around respective vertical axes and which are adapted to rest against lateral surfaces of the sole of the boot.

26. The apparatus according to claim 18, wherein the movable jaw of each of the binding assemblies carries an upper horizontal roller rotatably mounted around a generally horizontal and transverse axis in a hollow provided in the movable jaw, the horizontal roller being adapted to rest upon an upper edge of a sole of a boot, and the movable jaw further carrying, below the upper horizontal roller and on either lateral side of the horizontal roller, a respective vertical roller, the vertical rollers being rotatably mounted around respective vertical axes and which are adapted to rest against lateral surfaces of the sole of the boot.

27. The apparatus according the claim 19, wherein the movable jaw of each of the binding assemblies carries an upper horizontal roller rotatably mounted around a generally horizontal and transverse axis in a hollow provided in the movable jaw, the roller being adapted to rest upon an upper edge of a sole of a boot, and the movable jaw further carrying, below the upper horizontal roller and on either lateral side of the horizontal roller, a respective vertical roller, the vertical rollers being rotatably mounted around respective vertical axes and which are adapted to rest against lateral surfaces of the sole of the boot.

28. The apparatus according to claim 17, wherein the movable support plate has an upper surface having a plurality of longitudinally spaced transversely extending notches communicating by means of a central groove, wherein the pair of flexible linking devices comprises a pair of flexible traction cables, each cable having a head at an end of the cable, the end being selectively housed and retained in one of the plurality of transverse notches, and a longitudinally extending segment located within the central groove, and wherein the slide plate is biased towards the fixed seat by means of a respective one of the flexible traction cables connected to the energizing mechanism.

29. The apparatus according to claim 18, wherein the movable support plate has an upper surface having a plurality of longitudinally spaced transversely extending notches communicating by means of a central groove, wherein the pair of flexible linking devices comprises a pair of flexible traction cables, each cable having a head at an end of the cable, the end being selectively housed and retained in one of the plurality of transverse notches, and a longitudinally extending segment located within the central groove, and wherein the slide plate is biased towards the fixed seat by means of a respective one of the flexible traction cables connected to the energizing mechanism.

30. The apparatus according to claim 19, wherein the movable support plate has an upper surface having a plurality of longitudinally spaced transversely extending notches communicating by means of a central groove, wherein the pair of flexible linking devices comprises a pair of flexible traction cables, each cable having a head at an end of the cable, the end being selectively housed and retained in one of the plurality of transverse notches, and a longitudinally extending segment located within the central groove, and wherein the slide plate is biased towards the fixed seat by means of a respective one of the flexible traction cables connected to the energizing mechanism.

31. The apparatus according to claim 28, wherein each of the notches are formed, in a vertical longitudinal cross-section, generally in the general shape of a V, which is slightly inclined rearwardly for facilitating the retention of the head of the respective cable in the notch in which it is housed.

32. The apparatus according to claim 29, wherein each of the notches are formed, in a vertical longitudinal cross-section, generally in the general shape of a V, which is slightly inclined rearwardly for facilitating the retention of the head of the respective cable in the notch in which it is housed.

33. The apparatus according to claim 30, wherein each of the notches are formed, in a vertical longitudinal cross-section, generally in the general shape of a V, which is slightly inclined rearwardly for facilitating the retention of the head of the respective cable in the notch in which it is housed.

34. The apparatus according to claim 28, wherein each of the flexible traction cables extends from the common energizing mechanism and is introduced transversely in a respective one of the binding assemblies, wherein the flexible traction cable then is deviated to form the longitudinal segment, wherein each of the binding assemblies includes a projection spaced from a front face of the fixed support plate to thereby define, on either side of the longitudinal axis of the binding assembly, a passage for the guiding of the cable as the cable is transversely introduced in the binding assembly, thereby bending the cable on one of two front faces of the projection within a respective one of the passages, the projection having in an axial central part, an axial hole through which a cable passes, after having been deviated on one of the front faces of the projection, the cable then extending towards the movable jaw while forming the longitudinal segment.

35. The apparatus according to claim 16, wherein the flexible linking devices comprise two flexible traction cables operatively affixed, at one of their respective ends, to the movable jaws of the binding assemblies and, at a second of their respective ends, to the common energizing mechanism, the common energizing mechanism further comprising a bearing member containing a spring and which exerts equal and opposite traction forces on the two cables through portions of the common energizing mechanism, the apparatus further comprising a booting and de-booting lever journalled on the bearing member and movable between a booting position, in which the lever extends in a generally horizontal position, in which position the portions of the common energizing mechanism and the spring compress the spring and tension the traction cables, and a de-booting position, in which the lever extends toward a perpendicular position, in which position the portions of the common energizing mechanism and the spring de-compress the spring and relax the traction cables.

36. The apparatus according to claim 35, wherein the bearing member is elongated in a longitudinal direction of the snowboard and in the direction of the two cables, wherein the bearing is open towards the bottom and is closed on one end by a transverse wall, the transverse wall having a hole through which a first threaded shaft extends, the transverse wall having an inside wall, wherein the first threaded shaft has a head which rests against the inside wall of the transverse wall, an internally threaded socket, the socket having, opposite of the first threaded shaft, a wall having a hole through which a first one of the traction cables extend, the wall of the socket serving to retain a head affixed to the end of the first cable, wherein a second shaft has a head which is adjacent the head of the first shaft, wherein the second shaft extends from said head of said second shaft along the longitudinal axis of the first shaft, wherein the common energizing mechanism further includes a support adapted to be fixed to the snowboard for supporting a forward portion of the bearing, which covers the support, the support having a vertical wing having an opening through which the second shaft extends, the support having a surface against which an end of the spring is supported, the spring surrounding the second shaft, the support further including a horizontal lower wing which is adapted to rest on the upper surface of the snowboard, while being adapted to slide thereon to a predetermined extent, the second shaft extending from the support outside of the bearing member and having a threaded part upon which a second socket is threaded, the second socket having a wall through which a second of the traction cables extends, the second cable having a head located with the second socket for retaining the second cable.

37. The apparatus according to claim 36, wherein the booting and de-booting lever is journalled on the support around a generally horizontal and transverse axis, and is journalled to the bearing member around a second generally horizontal and transverse axis, wherein, in a booting position, the booting and de-booting lever extends generally horizontally and the second axis is located below the first axis, during which the spring is compressed. between the head of the second shaft and the surface of the support which said spring biases towards the second traction cable.

38. The apparatus according to claim 36, wherein the vertical wing of the support ends in an upper vertical finger engaged in a longitudinal elongated slot formed in a horizontal upper wall of the bearing member.

39. The apparatus according to claim 36, wherein the horizontal lower wing of the support includes a longitudinally elongated slot through which a screw is adapted to extend and is fixed into the snowboard such that the support is slidable along a distance which is limited by two ends of the longitudinal slot engaging the screw.

40. The apparatus according to claim 16, wherein the means for mounting the retention jaws for longitudinal movement with respect to the snowboard comprises a movable rear slide plate for each of the front and rear binding assemblies, each of the rear slide plates comprising a respective support plate carrying a respective one of the retention jaws, wherein the front and rear binding assemblies further comprises respective front fixed jaws, wherein the pair of flexible linking devices comprises two flexible traction cables which are hooked, in each of the binding assemblies to a respective one of the support plates, for biasing each of the retention jaws towards a respective one of the front fixed jaws.

41. A binding apparatus comprising:

(a) a front binding assembly comprising means for retaining a front boot on a ski and a rear binding assembly comprising means for retaining a rear boot on the ski;

(b) each of said binding assemblies having a respective longitudinally movable jaw for retaining an end of a respective one of said front and rear boots and respective means for mounting said respective jaws for longitudinal movement;

(c) an energization mechanism for exerting a common biasing force on both of said movable jaws of each of said front binding assembly and said rear binding assembly; and (d) means for linking said energization mechanism to each of said movable jaws of said front binding assembly and said second binding assembly comprising a flexible linkage member connected between said front binding assembly and said energization mechanism and a flexible linkage member connected between said rear binding assembly and said energization mechanism.

* * * * *